US007041000B1

(12) United States Patent
Galloway

(10) Patent No.: US 7,041,000 B1
(45) Date of Patent: May 9, 2006

(54) TRAINING GOLF CLUB

(75) Inventor: Trent D. Galloway, Minden, NV (US)

(73) Assignee: Accel Golf, Inc., Gardnerville, NV (US)

( * ) Notice: Subject to any disclaimer, the term of this patent is extended or adjusted under 35 U.S.C. 154(b) by 0 days.

(21) Appl. No.: 10/777,831

(22) Filed: Feb. 12, 2004

(51) Int. Cl.
*A63B 69/36* (2006.01)
*A63B 53/00* (2006.01)

(52) U.S. Cl. ..... 473/256; 473/297; 473/320

(58) Field of Classification Search ..... 473/219, 473/223, 226, 256, 297, 318, 312, 316–323, 473/523, 564–567
See application file for complete search history.

(56) References Cited

U.S. PATENT DOCUMENTS

| | | | | |
|---|---|---|---|---|
| 2,051,083 | A * | 8/1936 | Hart | 473/297 |
| 2,130,395 | A * | 8/1938 | Lard | 473/305 |
| 3,606,327 | A * | 9/1971 | Gorman | 473/297 |
| 3,941,390 | A | 3/1976 | Hussey | |
| 4,461,479 | A * | 7/1984 | Mitchell | 473/292 |
| 4,511,147 | A | 4/1985 | Olsen | |
| 4,953,861 | A * | 9/1990 | Nakanishi | 473/300 |
| 5,026,063 | A | 6/1991 | Rhodes | |
| 5,082,279 | A * | 1/1992 | Hull et al. | 473/242 |
| 5,152,527 | A * | 10/1992 | Mather et al. | 473/291 |
| 5,205,552 | A * | 4/1993 | Green, Jr. | 473/312 |
| 5,228,688 | A | 7/1993 | Davis | |
| 5,261,669 | A * | 11/1993 | Kochevar | 473/312 |
| 5,316,306 | A | 5/1994 | Cody | |
| 5,374,062 | A * | 12/1994 | Kochevar | 473/312 |
| 5,554,078 | A * | 9/1996 | Hannon et al. | 473/292 |
| 5,897,469 | A | 4/1999 | Yalch | |
| 5,989,131 | A | 11/1999 | Burkholder | |
| 6,080,069 | A | 6/2000 | Long | |
| 6,083,118 | A | 7/2000 | Martins et al. | |
| 6,106,411 | A | 8/2000 | Edwards | |
| 6,120,388 | A | 9/2000 | Blough et al. | |
| 6,176,790 | B1 | 1/2001 | Latella | |
| 6,186,904 | B1 * | 2/2001 | Bass | 473/256 |
| 6,241,623 | B1 * | 6/2001 | Laibangyang | 473/232 |
| 6,287,215 | B1 * | 9/2001 | Fisher | 473/309 |
| 6,379,261 | B1 | 4/2002 | Hart | |
| 6,394,909 | B1 * | 5/2002 | Laibangyang | 473/232 |
| 6,471,603 | B1 | 10/2002 | Kosmatka | |
| 2001/0006913 | A1 | 7/2001 | Shiraishi et al. | |
| 2002/0091010 | A1 | 7/2002 | Tanimoto | |
| 2003/0078114 | A1 | 4/2003 | Bamber | |

FOREIGN PATENT DOCUMENTS

| | | |
|---|---|---|
| GB | 2 040 693 A | 9/1980 |

* cited by examiner

*Primary Examiner*—Nini F. Legesse
(74) *Attorney, Agent, or Firm*—David H. Jaffer; Pillsbury Winthrop Shaw Pittman LLP

(57) ABSTRACT

The training golf club is provided with a shaft that has two weights added into the shaft, thereby allowing the club to assist the golfer in producing a golf swing that is in a plane and has a fluid tempo to improve the golf swing effectiveness. A first weight is added internally in the club shaft between the grip and the head end of the shaft, and a second weight is added internally at the head end of the shaft where the shaft attaches to the club head.

7 Claims, 1 Drawing Sheet

FIG.1
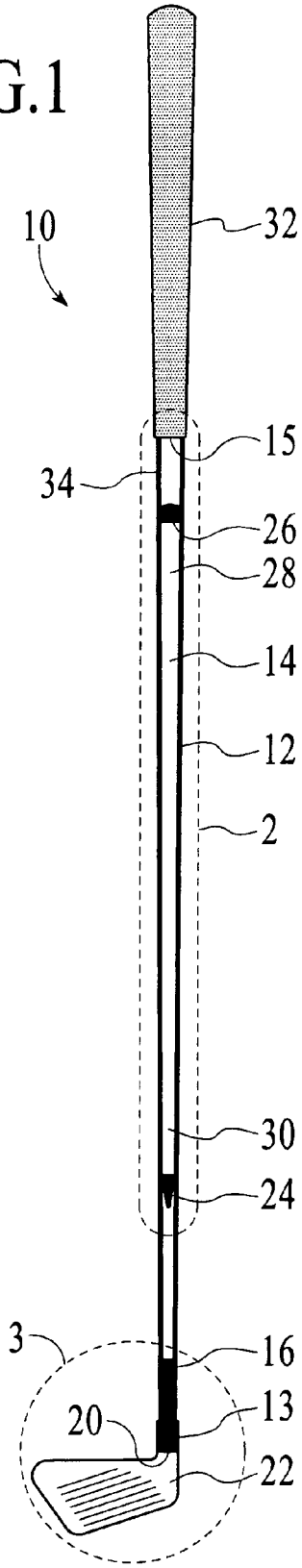
FIG.2
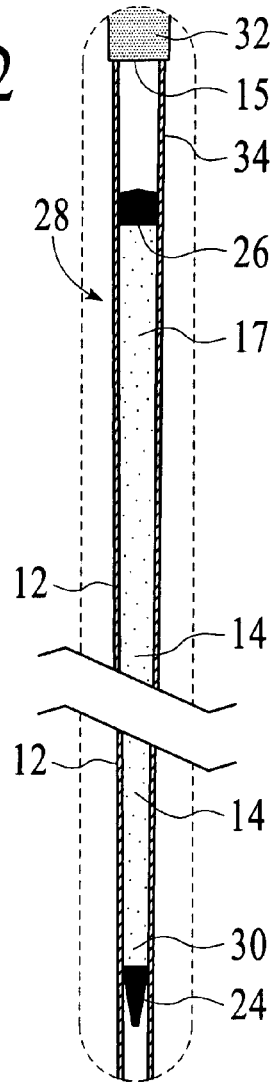
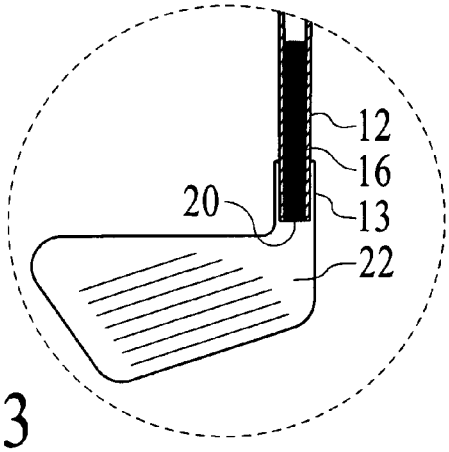
FIG.3

TRAINING GOLF CLUB

BACKGROUND OF THE INVENTION

1. Field of the Invention

The present invention relates to a training golf club for use by a golfer to improve his swing plane and swing tempo. Specifically, the present golf club is provided with a weighted flexible shaft having two separate weighted sections. The golf club helps a golfer improve the swing plane, timing and tempo of his swing that can be carried over to the golfer's use of actual playing clubs.

2. Description of the Related Art

There are hundreds of training devices designed to help a golfer improve his golf swing. Many of those inventions are designed to help the golfer increase the speed and force with which they swing their club and thereby make the golf ball travel further.

The notion that the faster that a golfer swings a golf club, the farther the golf ball will go is only true when the ball is struck in the sweet spot of the clubface. Accomplishing this maximum club head speed requires a good swing plane and good swing tempo. Improvement to achieve a good swing plane and fluid tempo is the foundation of a good golf swing. The purpose of the present invention is to provide a training golf club that will help a golfer to develop such a swing, regardless of the golfer's skill level.

SUMMARY OF THE INVENTION

The present invention is a training golf club that is used when practicing a golf swing or hitting golf balls on a practice range. The training golf club is provided with a flexible hollow shaft that has had a couple of weights added to the shaft. The training club is provided with a calculated weight and position for each weight within the hollow shaft. One weight is preferably added internally in the club shaft along the length of the shaft, and a second weight is preferably added internally at the head end of the shaft where the shaft attaches to the hosel of the club head. The first weight is located approximately 4 inches above the club head hosel and extends to approximately 2 inches below the bottom of the training club grip. The second weight is located at the end of the shaft where the shaft attaches to the club head hosel so that the second weight is flush with the end of the shaft. By virtue of adding weights to the training golf club in this matter, the club enables the golfer to develop a golf swing that will be on a plane and have a fluid swing tempo so that it will produce an improved ball striking ability.

BRIEF DESCRIPTION OF THE DRAWINGS

FIG. 1 is a front view of a training golf club constructed in accordance with a preferred embodiment of the present invention, with the internal structure of the shaft shown in outline.

FIG. 2 is an enlarged cross sectional view of the portion of the shaft contained within circle 2 of FIG. 1.

FIG. 3 is an enlarged cross sectional view of the end of the shaft contained with circle 3 of FIG. 1.

DETAILED DESCRIPTION OF THE PREFERRED EMBODIMENT THE INVENTION

Referring now to the drawings and initially to FIG. 1, there is illustrated a training golf club 10 for used when practicing a golf swing or hitting golf balls on a practice range that is constructed in accordance with a preferred embodiment of the present invention. The training golf club 10 is provided with a flexible hollow shaft 12 that has had weights 14 and 16 added and secured internally in the shaft 12, for the purpose of assisting a golfer in producing an improved golf swing that is on a plane and has a fluid temp from start to finish of the swing, i.e. through their take-away, back swing, transition or top of the swing, down swing, and follow-through.

A first weight 14 is preferably added internally in the club shaft 12 approximately four (4) inches above a hosel 13 on a club head 22 and extends to approximately two (2) inches below a bottom 15 of a training club grip 32 provided on the shaft 12. The first weight is preferably between 4 and 6 ounces in weight, depending on whether the club 10 is for use by a golfer that is female or male.

A second weight 16 is preferably added internally in the shaft 12 so that it is located at a head end 20 of the shaft 12 where the shaft 12 attaches to the hosel 13 of the club head 22 and so that the second weight 16 is flush with the head end 20 of the shaft 12.

Referring now also to FIG. 2, the first weight 14 is preferably composed of #9 buckshot 17 that is secured inside the flexible shaft 12 between two plugs, a first plug 24 which is a lower plug and a second plug 26 which is an upper plug. The second plug 26 is provided at a grip end 28 of the first weight 14, and the first plug 24 is provided at an opposite head end 30 of the first weight. The first plug 24, which is preferably an ethylene propylene diene monomer (EPDM) tapered plug, is secured under compression of the buckshot 17, and the second plug 26 is preferably composed of silicon gel and is used to secure the first weight 14 approximately two (2) inches below the bottom 15 of a training club grip 32 provided on the shaft 12. The silicon gel will harden and adhere to the flexible shaft 12 within about twelve hours of application, thus producing the second or upper plug 26.

Referring now to FIG. 3, the second weight 16 is preferably composed of a brass insert that is preferably secured with epoxy glue within the shaft 12 so that the second weight 16 is flush with the head end 20 of the shaft 12. The brass insert is approximately 7.5 grams in weight.

Referring again to FIG. 1, once the weights 14 and 16 have been secured and set within the shaft 12, the club head 22 is secured via epoxy or other similar attachment means to the head end 20 of the club 10, and the training club grip 32 is attached externally to the upper end 34 of the shaft 12 to complete the training golf club 10.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A training golf club, comprising:

a flexible hollow shaft, a first weight including a compact distribution of a plurality of disconnected particles secured internally within the shaft between a head end of the shaft where the shaft attaches to a club head and a grip end of the shaft where a training club grip attaches to the shaft, a first lower plug and a second upper plug for compactly securing said particles within the shaft, wherein the first lower plug is an EPDM tapered plug and the second upper plug is a silicon gel plug, a second weight secured internally within the shaft at the head end of the shaft, a club head attached to the head end of the shaft by a hosel provided on the club head, and a training club grip secured to an upper end of the shaft.

2. A training golf club according to claim 1 wherein the first weight extends from approximately 4 inches above the hosel to approximately 2 inches below a bottom of the training club grip.

3. A training golf club according to claim 1 wherein the first weight is between approximately 4 and 6 ounces in weight.

4. A training golf club according to claim 1 wherein said particles are #9 buckshot.

5. A training golf club according to claim 1 wherein said second weight is secured within the shaft so that said second weight is flush with the head end of the shaft.

6. A training golf club according to claim 1 wherein the second weight is approximately 7.5 grams in weight.

7. A training golf club according to claim 1 wherein the second weight is a brass insert.

* * * * *